US006191416B1

(12) United States Patent
Tschersich et al.

(10) Patent No.: US 6,191,416 B1
(45) Date of Patent: Feb. 20, 2001

(54) APPARATUS FOR PRODUCING A BEAM OF ATOMS OR RADICALS

(75) Inventors: Karl G. Tschersich, Jülich; Johannes Fleischhauer, Heinsberg, both of (DE)

(73) Assignee: Forschungszentrum Julich GmbH, Julich (DE)

( * ) Notice: Under 35 U.S.C. 154(b), the term of this patent shall be extended for 0 days.

(21) Appl. No.: 09/252,349

(22) Filed: Feb. 18, 1999

(30) Foreign Application Priority Data

Feb. 18, 1998 (DE) ..... 198 06 692

(51) Int. Cl.[7] ..... H05H 3/02
(52) U.S. Cl. ..... 250/251; 118/724; 422/199
(58) Field of Search ..... 250/251; 118/724; 422/199

(56) References Cited

U.S. PATENT DOCUMENTS 4,878,989 * 11/1989 Purdes ..... 118/724
5,541,407 * 7/1996 Leone et al. ..... 250/251
5,693,173 * 12/1997 Colombo et al. ..... 118/724

OTHER PUBLICATIONS

"Simple Source of Atomic Hydrogen for Ultrahigh Vacuum Applications", U.Bischler, 1993 American Vacuum Society, 3 pages.

"High Temperature Metal Atom Beam Sources", K.F.Ross, 1995 American Institute of Physics, 25 pages.

"Some Properties of Hydrogenated Amorphous Silicon Produced by Direct Reaction of Silicon and Hydrogen Atoms", R.E.Viturro, Philosophical Magazin, 1986, vol.53, 6 pages.

* cited by examiner

*Primary Examiner*—Jack Berman
(74) *Attorney, Agent, or Firm*—Herbert Dubno

(57) ABSTRACT

A stream of gas can be thermally decomposed in a tube along which a radiant heating wire extends to a stream of free atoms or radicals. The wire, which can be formed as a coil is connected at one end of the tube close to its outlet so that the tube provides an electrical contact for the wire and mechanically supports it.

7 Claims, 3 Drawing Sheets

APPARATUS FOR PRODUCING A BEAM OF ATOMS OR RADICALS

FIELD OF THE INVENTION

Our present invention relates to an apparatus for generating a beam or stream of atoms or radicals by thermal dissociation of a gas. More particularly, the invention relates to an apparatus for producing a stream of particles, for example atoms and radicals, produced by thermal dissociation of a gas, of the type which comprises a tube, one end of which is connected to a gas source while the stream emerges from the opposite end and a heating device is provided for heating the tube.

BACKGROUND OF THE INVENTION

The apparatus for producing a stream of atoms or radicals by thermal dissociation of a gas as it traverses a heated tube through which the gas flows axially, is known and reference may be had to the article entitled "Some Properties of Hydrogenated Amorphous Silicon Produced by Direct Reaction of Silicon and Hydrogen Atoms", R. E. Viturro and K. Weiser in Philosophical Magazine B, 1986, Vol. 53, No. 2, pages 93–103.

For thermal dissociation of a gas at high temperatures, for example in the case of hydrogen or oxygen, the thermal dissociation temperature may have to be in the range of 1500 K to 2500 K. To be able to heat the gas passing through the tube to these high temperatures, conventional devices provide so-called electron bombardment heaters. In these, the electron source is a wire heated to glowing outside the tube and traversed by an electric current sufficient to cause the wire to emit electrons. A potential is provided between the electron source and the tube, e.g. of about 1000 volts, to accelerate the electrons toward the tube and cause them to impinge upon the tube so that a good part of the energy carried by the electrons is released on the tube and the gas flowing therethrough is thereby heated.

Electron bombardment has the advantage that a comparatively large amount of heat can be developed at the tube, i.e. that the heating power can be high, and further that the heat is concentrated at the tube rather than being dissipated. The electron bombardment technique, however, has the drawback that to generate the potential between the glow wire and the tube, the glow wire must be at close to ground potential and the tube must be brought to a high positive potential. In this case, the accelerated electrons can have in the region of the tube, sufficient energy for the impingement-type ionization of the gases which ultimately emerge from the tube as well as residual gas.

The resulting positive ions are accelerated away from the tube and thus there is an atomic beam which can cross the electron beam and dissipate energy.

In addition the beam emerging from the tube can be contaminated with ions from extrinsic sources because of the high energy of all of the atomic and subatomic particles involved in the process. Contamination of the beam of atoms or radicals may present a significant problem for the ultimate use of the beam.

It is possible to avoid contamination of the beam by ions by maintaining the tube at ground potential while providing the glow wire at a high potential. This arrangement has the drawback that it forms an "electron reflector" at the high potential which is so arranged that the electrons are accelerated only toward the tube and are not accelerated to further components also at ground potential.

The high voltage components must be sufficiently insulated and electron emission in extraneous directions must be suppressed, all of which significantly increases the fabrication cost of the apparatus and limits the use thereof in earlier systems. The need for high voltage insulation is particularly a problem since the components which must be insulated are also at high temperatures in practice. There is a significant danger that the insulator will be vaporized and the insulation effect lost.

Frequently it has also been found to be a drawback that the electrical source for electron bombardment heating comprises a high voltage unit which provides an electron emission current from about 60 mA to about 0.7 A, an electron-emission current regulator which must have positive feedback coupling between the tube temperature and the glow wire temperature to avoid unstable emission currents and other elements all of which contribute to a very high cost of the apparatus and introduce places at which failure can occur.

OBJECTS OF THE INVENTION

It is, therefore, the principal object of the present invention to provide an apparatus for generating a stream or beam of atoms or radicals by thermal dissociation of a gas whereby all of these drawbacks can be avoided.

More specifically it is the object of the invention to provide an improved apparatus for producing a particle beam of atoms or radicals by such thermal dissociation of a gas, whereby contamination of the atomic beam by ions or the like resulting from electron bombardment techniques are avoided.

It is also an object of the invention to provide a low cost and reliable apparatus for the purposes described wherein, especially, the cost factors for power supply and control and the need for electrical insulation are reduced and reliability is improved.

SUMMARY OF THE INVENTION

These objects and others which will become apparent hereinafter are attained in an apparatus for producing a stream of atomic particles in the form of free atoms or radicals which comprises:

an elongated heat-conductive and thermally conductive tube formed at one end with means for connecting the tube to a source of a gas capable of being thermally decomposed to form the atomic particles, the tube being formed at an opposite end with an outlet for the stream of atomic particles;

at last one heating wire extending along the tube and spaced from the tube over at last a major portion of a length of the wire whereby the tube is radiantly heated by the wire to a temperature sufficient to thermally decompose the gas and form the atomic particles, the wire having an electrical contact with the tube at a location proximal to the outlet and being spaced form the tube over a remainder of a length of the wire juxtaposed with the tube; and an electrical energy source connected to the wire for passing an electric current therethrough to cause the wire to radiantly heat the tube.

In the system of the invention, therefore, the heating device comprises at least one heating wire for radiantly heating the tube and connects that heating wire electrically to the tube in the region of the gas outlet opening. Over the remainder of the length of that heating wire, it is spaced from the tube but extends along the length thereof, preferably from the end at which the gas is introduced to the point at which electrical contact is made between that heating wire and the tube.

As a consequence, the invention provides for the heating of the tube to effect thermal dissociation of the gas traversing the tube not as in the art by electron bombardment, but by thermal radiation heating. All of the drawbacks of electron bombardment heating can thus be avoided. The impact ionization of the gases at the mouth of the tube by accelerated electrons, the contamination by ions, the movement of ions or electrons across the path of the dissociated atomic particles and the drawbacks resulting from an electron reflector system are eliminated.

Indeed no high voltage is required for the resistance heating of the present invention and hence the need for a high voltage source, the special requirements for high voltage insulation, and even the need for electron emission control or regulation are all eliminated and the apparatus of the invention is greatly simplified and much less expensive by comparison with earlier apparatus.

By providing the contact of the heating wire with the tube, the heating current from the heating wire can flow through the tube to ground.

According to a feature of the invention the heating wire can be formed as a coil around the tube with at least one turn and preferably two at the end of a heating wire being wrapped tightly around the tube to hug the latter and form the electrical contact. In this configuration, the tube acts as a support for the heating wire in the region of the gas outlet opening and precludes deformation of the hot wire in its heated state so that a short circuit to the tube of earlier turns or stretches for the heating wire ahead of the turns hugging the tube can be avoided. Furthermore the structural support for the heating wire provided by the tube prevents short circuiting to heat reflectors such as sheet metal elements which may be provided externally of the heating wire and can be arranged around the heating wire and the tube at least over a portion of the length thereof.

Reflectors of the type described ensure better utilization of the ohmic heat produced by the heating wire. It will be understood that, with the system of the invention wherein one end of the heating coil is directly affixed to the tube and thus supported thereby, by contrast with prior art systems in which an electron emitting wire is located in juxtaposition with the tube and has no contact therewith and is fully insulated therefrom, there is less danger of a short circuit to the tube in a region of the wire intended to be spaced from the attachment turn or turns.

Of course a plurality of heating wires can be provided and the tube and the wire can be surrounded by a water-cooled housing enclosing the tube and wire at least over a length of the tube along which the wire extends.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
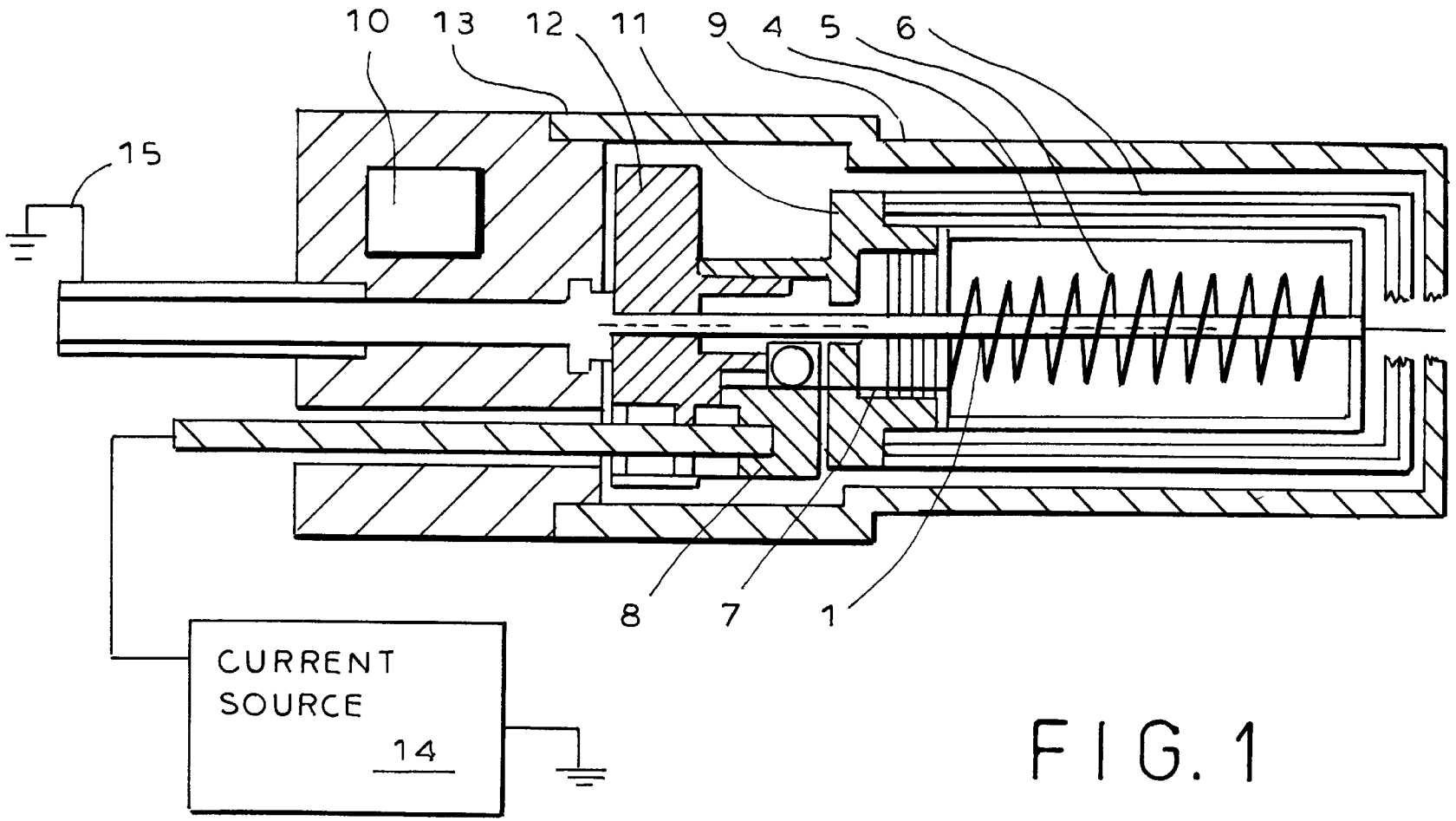
FIG. 1 is a diagrammatic section through an apparatus for producing a stream of atoms or radicals according to the invention.
Figure 2:
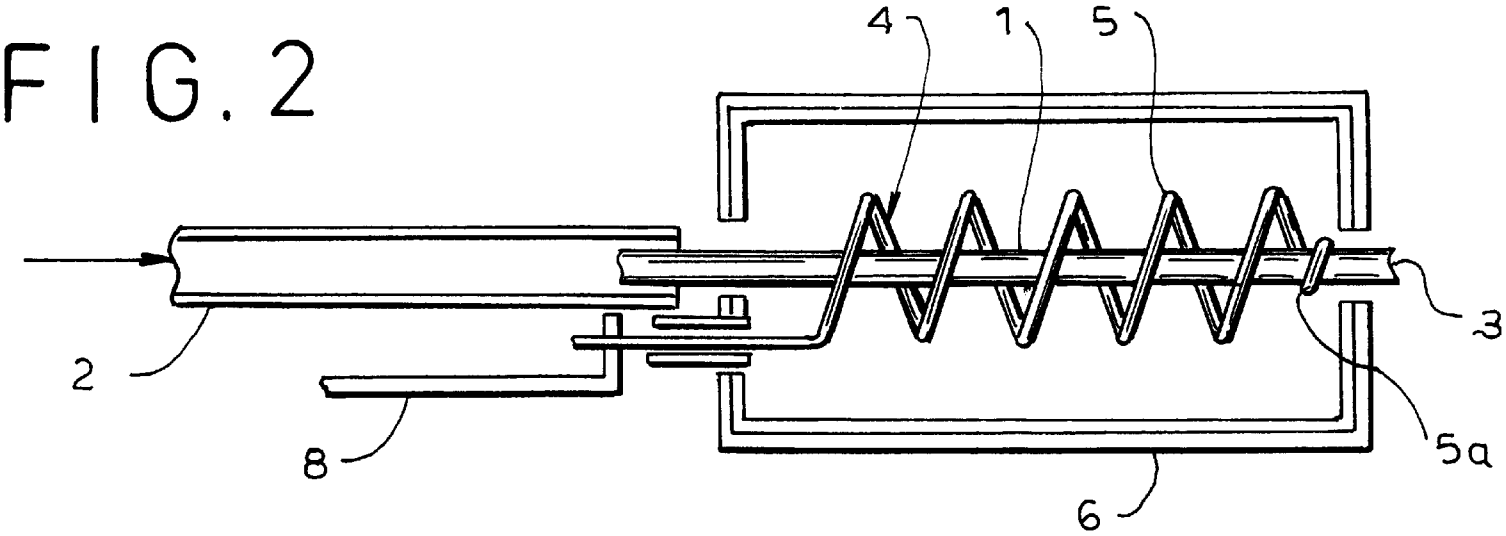
FIG. 2 is a diagrammatic enlarged detail of a part of FIG. 1.

FIGS. 1 and 2 of the drawing show an apparatus according to the invention for generating a stream or beam of atoms or radicals by the thermal dissociation of a gas. This apparatus can be used, for example, to thermally dissociate a hydrogen gas and thereby produce a stream of hydrogen atoms which can react with some other element or compound. The thermal dissociation is achieved by the radiation heating of the gas to be dissociated in a tube 1. The tube 1 composed of a thermally conductive and electrically conductive material, e.g. a metal having a high melting point such as titanium, can be connected to a source of the gas to be dissociated, represented by the gas line 2 and can be heated to a temperature in the range of 1500 to 2500 K.

The opposite end of the tube 1 has a gas outlet opening 3. The length of the tube 1 in the example illustrated in FIGS. 1 and 2 for the thermal dissociation of hydrogen, can be 64 mm and its internal diameter can be 1 mm.

For heating tube 1 a resistance heating unit represented at 4 is provided. The heating unit 4 can comprise a helically coiled heating wire 5, e.g. of tungsten, which coaxially surrounds the tube 1. The heating wire 5 can have an extended length of about 300 mm and a diameter of 0.5 mm and thus is substantially longer than the tube 1. At one end, the coil 5 is formed with two tight turns 5*a* which hug the tube 1 adjacent the outlet opening 3. At the other end, the coil 5 is insulated from the tube 1 and is anchored in a holder 7. An electric conductor 8 connects the coil 5 with an electric current source 14, the other side of which is grounded. The tube 1 is likewise grounded as has been represented at 15.

Because of the electrical connection of the coil 5 to the tube 1 at the end of the coil remote from its connection to the current source 14, the remote end of the coil 5 is connected to ground via the tube 1. Furthermore, the coil is mechanically supported by the tube 1 which thus prevents significant deformation of the coil 5 in the heated state so that short circuiting of the coil between the narrow turn 5*a* and the holder 7 can be avoided. A short circuit between the coil 5 and other parts is also prevented. The danger of short circuiting is pronounced when both ends of a heating wire are mounted in insulators and a reflective sheet metal member such as is shown at 6 surrounds the heating wire.

In the embodiment of the invention, such a reflector can be provided at 6 so that over the heating region in which the tube 1 is heated by the device 4, heat which tends to be radiated away from the tube 1 is reflected back toward the latter and hence the heat generated by the coil 5 is more effectively used. The reflector 6 can be a stack of sheet metal reflective members, i.e. a number of spaced-apart cylindrical sheet metal reflectors which are coaxial with one another.

Externally of the reflective stack 6, a housing 9 can be provided, the housing preferably being in the form of a cylindrical copper shell and being provided with a water-cooling system represented diagrammatically by the water-cooling channel 10. Within the housing 9, the reflector 6 is held in a member 11 composed of a material of high temperature resistance, for example, a refractory ceramic. The housing 9 also receives a holder 12 which is electrically insulating and heat resistant as well and which carries the tube 1 at the gas supply side thereof and which can be affixed by a screw arrangement, not shown, to the water-cooled body against which the holder 12 can be drawn and sealed.

In operation, the heating coil 5 can be supplied with a voltage of 13 volts and a current of 11.5 amperes to operate at 150 watts. The gas temperature in the region of the outlet 3 is approximately 2200 K which is sufficient to thermally dissociate the hydrogen. From the resistance increase of the coil it can be calculated that the coil temperature is 2350 K and thus only 150 K above the tube temperature. The fact that the temperature of the coil is only slightly higher than that of the tube is significant since the vaporization loss of tungsten from the heating wire is limited and the heating wire thus has a long operating life. Tests have shown that the angular spread of the beam of atomic hydrogen emitted at the opening 3 and its degree of dissociation are significant improvements over those obtained with electron bombardment heating and that the drawbacks of electron bombardment heating are avoided with the system of the invention.

Figure 4:
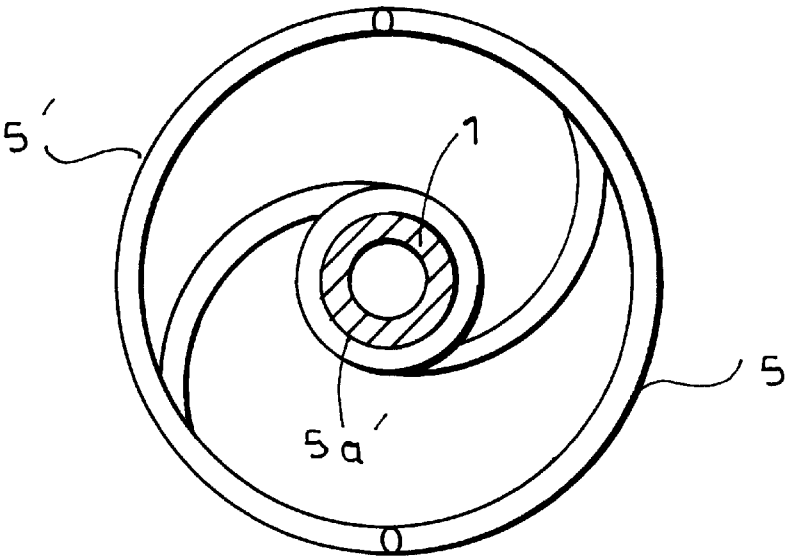
FIG. 4 is a cross sectional view taken along the line IV—IV of FIG. 3.
Figure 3:
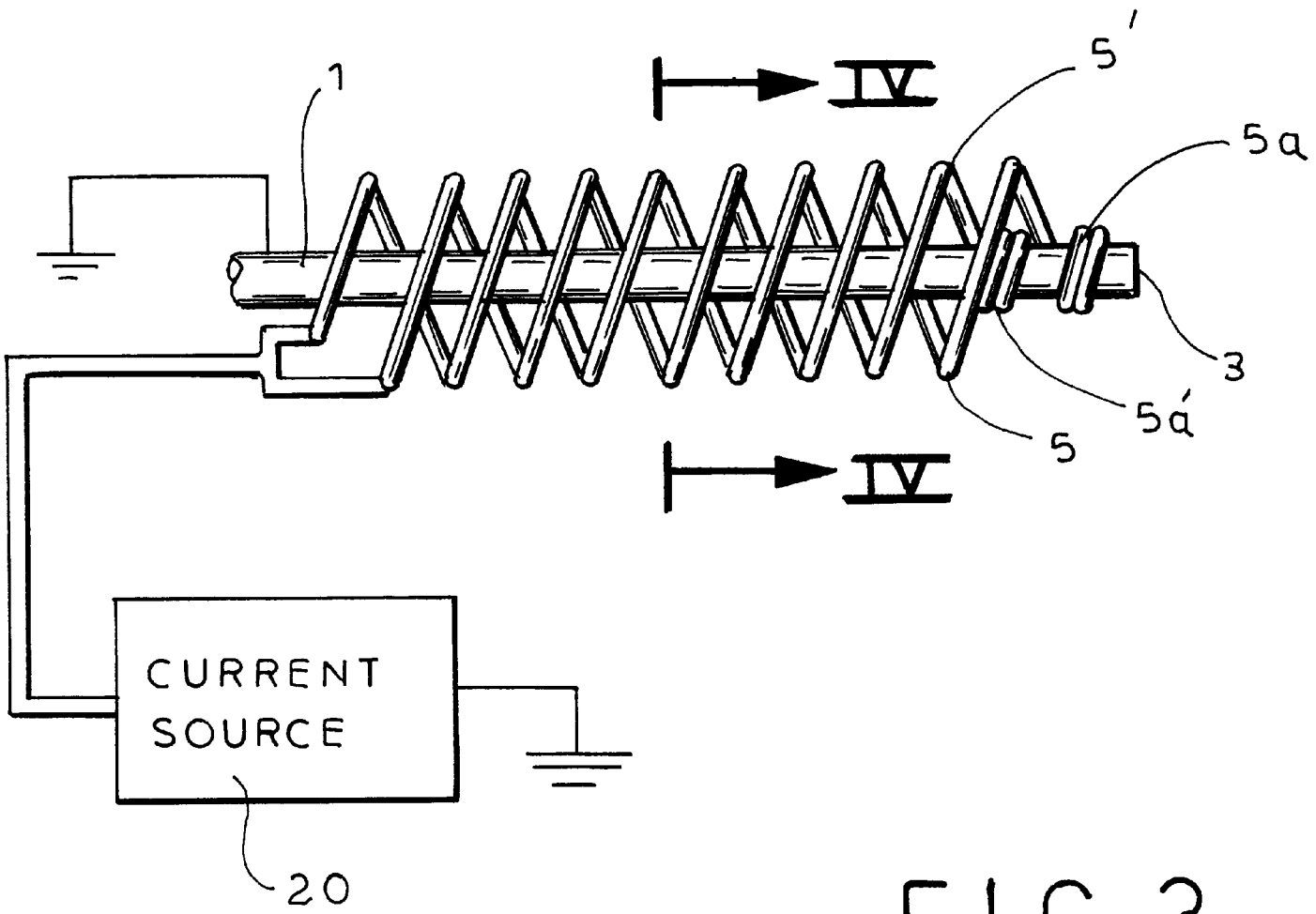
FIG. 3 is a view showing two heating wires in juxtaposition with the tube.

It can be seen from FIGS. 3 and 4 that two or more coils 5, 5' can surround the tube 1 and can have at their ends remote from the connection to the current source 20, tight turns 5*a* and 5*a*' hugging the tube 1 adjacent the outlet 3.

We claim:

1. An apparatus for producing a stream of atomic particles in the form of free atoms or radicals, said apparatus comprising:

an elongated heat-conductive and thermally conductive tube formed at one end with means for connecting said tube to a source of a gas capable of being thermally decomposed to form said atomic particles, said tube being formed at an opposite end with an outlet for said stream of atomic particles;

at least one heating wire extending along said tube and spaced from said tube over at least a major portion of a length of said wire whereby said tube is radiantly heated by said wire to a temperature sufficient to thermally decompose said gas and form said atomic particles, said wire having an electrical contact with said tube at a location proximal to said outlet and being spaced from said tube over a remainder of a length of said wire juxtaposed with said tube; and an electrical energy source connected to said wire for passing an electric current therethrough to cause said wire to radiantly heat said tube.

2. The apparatus defined in claim 1 wherein said at least one heating wire is in the form of a helical coil surrounding said tube.

3. The apparatus defined in claim 2 wherein said coil has at least one tight turn at an end of said coil and proximal to said outlet and hugging said tube to form the electrical contact between said tube and said heating wire.

4. The apparatus defined in claim 1 wherein a plurality of said heating wires are provided.

5. The apparatus defined in claim 1, further comprising a heat reflector surrounding said tube over a region thereof in which said wire extends along said tube.

6. The apparatus defined in claim 5 wherein said heat reflector is composed of a sheet-metal radiator.

7. The apparatus defined in claim 1, further comprising a water-cooled housing enclosing said tube and said wire at least over a length of said tube along which said wire extends.

* * * * *